US010697225B2

(12) United States Patent
Qiu

(10) Patent No.: US 10,697,225 B2
(45) Date of Patent: Jun. 30, 2020

(54) GATE OPENING APPARATUS

(71) Applicant: Qianliang Qiu, Arcadia, CA (US)

(72) Inventor: Qianliang Qiu, Arcadia, CA (US)

( * ) Notice: Subject to any disclaimer, the term of this patent is extended or adjusted under 35 U.S.C. 154(b) by 155 days.

(21) Appl. No.: 15/970,577

(22) Filed: May 3, 2018

(65) Prior Publication Data

US 2019/0338579 A1 Nov. 7, 2019

(51) Int. Cl.
*E05F 11/00* (2006.01)
*E05F 15/643* (2015.01)

(52) U.S. Cl.
CPC ..... *E05F 15/643* (2015.01); *E05Y 2201/216* (2013.01); *E05Y 2201/232* (2013.01); *E05Y 2201/246* (2013.01); *E05Y 2201/41* (2013.01); *E05Y 2201/656* (2013.01); *E05Y 2900/40* (2013.01)

(58) Field of Classification Search
CPC ..... E05F 15/643; E05F 15/635; E05Y 2201/232; E05Y 2201/41; E05Y 2201/656; E05Y 2201/246; E05Y 2900/40
USPC ..... 49/360
See application file for complete search history.

(56) References Cited

U.S. PATENT DOCUMENTS 4,858,383 A * 8/1989 Kendig ..... E05F 15/72 49/360
6,025,685 A * 2/2000 Parsadayan ..... E05F 15/63 318/471
6,091,217 A * 7/2000 Parsadayan ..... E05F 15/41 318/283
6,092,338 A * 7/2000 Crowner ..... E05F 15/643 49/360
6,108,977 A * 8/2000 Payne ..... E05F 15/603 49/360
8,176,684 B2 * 5/2012 Marchetto ..... E05F 15/632 49/506
8,464,470 B2 * 6/2013 Katagata ..... B61B 1/02 49/360
8,707,627 B2 * 4/2014 Murray ..... E05F 15/643 49/506
9,341,022 B2 * 5/2016 Nicholson ..... E05F 11/54
9,406,207 B2 * 8/2016 Parsadayan ..... G08B 13/12
9,452,761 B2 * 9/2016 Romero ..... B61B 1/02
10,106,176 B2 * 10/2018 Romero ..... B61B 1/02
2008/0190031 A1 * 8/2008 Winkelmann ..... E05F 15/643 49/427
2011/0302841 A1 * 12/2011 Ye ..... E05F 15/622 49/340

(Continued)

*Primary Examiner* — Jerry E Redman
(74) *Attorney, Agent, or Firm* — Tsz Lung Yeung

(57) ABSTRACT

A gate opening apparatus includes an external housing, a main chassis, a motor device, a driving rotor, a plurality of guiding rollers, a transmission chain connecting the driving rotor, the guiding rollers and a door gate, and a gate actuating arrangement. The gate actuating arrangement includes a clutching device supported on the main chassis and connected to the motor device, a limit switch assembly coupled to the clutching device, and a control module. The gate opening apparatus is arranged to operate between a power mode and a manual mode. In the power mode, the clutching device is engaged with the driving rotor for driving a movement thereof by the motor device so as to selectively open and close the door gate. In the manual mode, the clutching device is disengaged from the driving rotor so that the driving rotor is adapted for being rotated manually.

22 Claims, 11 Drawing Sheets

(56) References Cited

U.S. PATENT DOCUMENTS

| | | | | |
|---|---|---|---|---|
| 2012/0031006 | A1* | 2/2012 | Katagata | B61B 1/02 49/360 |
| 2012/0066976 | A1* | 3/2012 | Murray | E05F 15/79 49/358 |
| 2012/0326867 | A1* | 12/2012 | Parsadayan | G08B 13/1654 340/541 |
| 2014/0259930 | A1* | 9/2014 | Gilliam | E01F 13/048 49/70 |

* cited by examiner

GATE OPENING APPARATUS

BACKGROUND OF THE PRESENT INVENTION

Field of Invention

The present invention relates to a gate opening apparatus, and more particularly to a gate opening apparatus comprising a gate actuating arrangement which has a substantially simplified structure and enhanced reliability as compared to conventional arts.

Description of Related Arts

A conventional gate opening apparatus for actuating a sliding movement of a door gate usually comprises an outer casing, a main chassis having an upper compartment and a lower compartment, a motor device mounted in the lower compartment of the main chassis, and an actuating mechanism provided in the upper compartment of the main chassis. The actuating mechanism usually comprises a plurality of driving rotors provided on the main chassis for connecting with the door gate through a plurality of chains, a gear assembly operatively mounted in the upper compartment of the main chassis, and a plurality of transmission belts connecting the motor device and the gear assembly.

During operation, the motor device drives the gear assembly to rotate through the corresponding transmission belt. The gear assembly will then drive the driving rotors to rotate in a predetermined direction. When the driving rotors rotate, the door gate will be driven to slide through the chain so that the door gate may be opened or closed in an automatic manner.

There are several disadvantages in association with the above-mentioned gate opening apparatus. First, the above-mentioned gate opening apparatus utilizes many transmission belts for transmission mechanical movements. The transmission belt thus mentioned requires frequent inspections and maintenance.

Second, for conventional gate opening apparatuses such as the one mentioned above, when power is cut off (such as when there is an outage in electricity supply), the gate opening apparatus may not be easily converted into manual operation. In most cases, a user may need to detach the outer casing from the main chassis and convert the gate opening apparatus from automatic mode to manual operation mode. What worse is that in some conventional gate opening apparatuses, a manual operation mode may not be available at all.

As a result, there is a need to improve upon conventional gate opening apparatuses so as to resolve the above-mentioned problem.

SUMMARY OF THE PRESENT INVENTION

Certain variations of the present invention provide a gate opening apparatus comprising a gate actuating arrangement which has a substantially simplified structure and enhanced reliability as compared to conventional arts.

Certain variations of the present invention provide a gate opening apparatus which is capable of selectively and easily switching from power operation mode to manual operation mode, or vice versa. Thus, a user may be able to easily switch to manual operation mode when electric supply to the present invention is cut off.

In one aspect of the present invention, it provides a gate opening apparatus for a door gate, comprising:

an external housing;

a main chassis received in the external housing;

a motor device provided in the main chassis;

a driving rotor rotatably mounted on the main chassis;

a plurality of guiding rollers rotatably mounted on the main chassis;

a transmission chain connecting the driving rotor, the guiding rollers and the door gate such that rotation of the driving rotor is capable of driving the door gate to slide at a predetermined direction through the guiding rollers and the transmission chain; and a gate actuating arrangement, which comprises:

a clutching device securely supported on the main chassis and connected to the motor device;

a limit switch assembly coupled to the clutching device, the limit switch assembly being arranged to set a limit upon which the driving rotor is rotated; and a control module mounted on the main chassis and electrically connected to the motor device and the clutching device for controlling an operation thereof, the gate opening apparatus being arranged to operate between a power mode and a manual mode, wherein in the power mode, the clutching device is engaged with the driving rotor for driving a movement thereof by the motor device so as to selectively open and close the door gate, wherein in the manual mode, the clutching device is disengaged from the driving rotor so that the driving rotor is adapted for being rotated manually.

This summary presented above is provided merely to introduce certain concepts and not to identify any key or essential features of the claimed subject matter.

DETAILED DESCRIPTION OF THE PREFERRED EMBODIMENT

Figure 1:
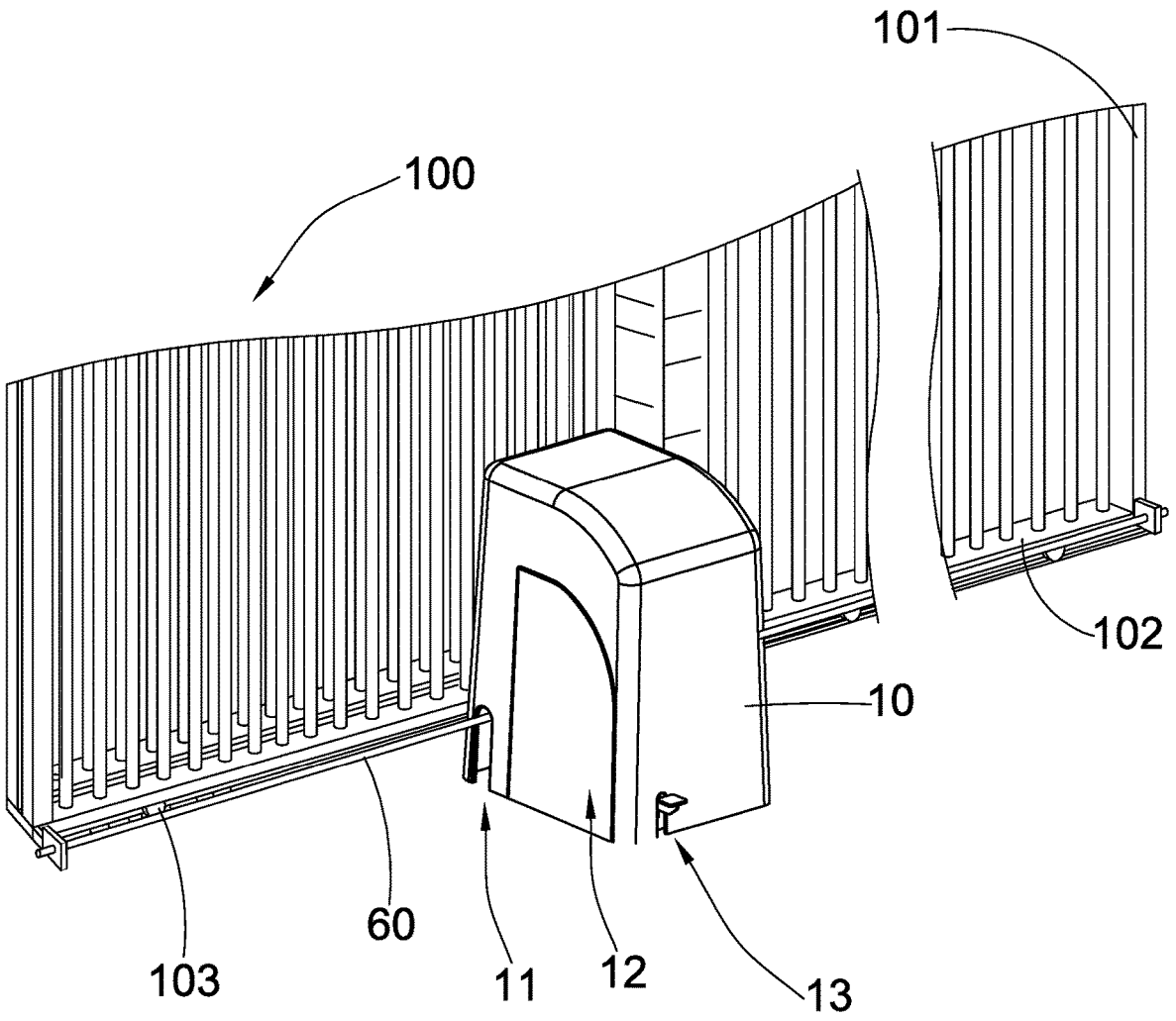
FIG. 1 a perspective view of a gate opening apparatus according to a preferred embodiment of the present invention.

The following detailed description of the preferred embodiment is the preferred mode of carrying out the invention. The description is not to be taken in any limiting sense. It is presented for the purpose of illustrating the general principles of the present invention.

Referring to FIG. 1 to FIG. 11 of the drawings, a gate opening apparatus according a preferred embodiment of the present invention is illustrated. Broadly, the gate opening apparatus may comprise an external housing 10, a main chassis 20, a motor device 30, a driving rotor 40, a plurality of guiding rollers 50, a transmission chain 60, and a gate actuating arrangement 70. The gate opening apparatus of the present invention is for slidably opening or closing a door gate 100.

The main chassis 20 may be received in the external housing 10. The motor device 30 may be provided on the main chassis 20.

The driving rotor 40 may be rotatably mounted on the main chassis 20. The guiding rollers 50 may also be rotatably mounted on the main chassis 20 at two sides of the driving rotor 40 respectively.

The transmission chain 60 may connect the driving rotor 40, the guiding rollers 50 and the gate 100 such that rotation of the driving rotor 40 may be capable of driving the door gate 100 to slide at a predetermined direction through the guiding rollers 50 and the transmission chain 60.

The gate actuating arrangement 70 may comprise a clutching device 71, a limit switch assembly 72 and a control module 73. The clutching device 71 may be securely supported on the main chassis 20 and connected to the motor device 30.

The limit switch assembly 72 may be coupled to the clutching device 71, and may be arranged to set a limit upon which the driving rotor 40 is rotated so as to control the extent to which the door gate 100 is driven to slide.

On the other hand, the control module 73 may be mounted on the main chassis 20 and electrically connected to the motor device 30 and the clutching device 71 for controlling an operation thereof. The gate opening apparatus may be arranged to operate between a power mode and a manual mode, wherein in the power mode, the clutching device 71 may be engaged with the driving rotor 40 for driving a movement thereof by the motor device 30 so as to selectively open and close the door gate 100, wherein in the manual mode, the clutching device 71 is disengaged from the driving rotor 40 so that the driving rotor 40 may be adapted for being rotated manually.

According to the preferred embodiment of the present invention, the gate opening apparatus may be embodied for a door gate 100 having an elongated structure. The door gate 100 may comprise a plurality of transverse members 101 and a plurality of longitudinal members 102 and may slide on a ground surface through a plurality of wheels 103 for opening or closing a particular space.

The external housing 10 may be adapted for substantially enclosing the main chassis 20 and the components supported thereon. The external housing 10 may have a plurality of through slots 11 formed thereon, wherein the transmission chain 60 may connect the driving rotor 40 to the door gate 100 through the through slots 11. The through slots 11 may be formed on two sidewalls 12 of the external housing 10 respectively.

The main chassis 20 may be made of metallic material and may serve as a base for supporting all other components of the gate opening apparatus. The main chassis 20 may comprise a base supporting frame 21, a top supporting frame 22 and a connecting member 23 extended between the base supporting frame 21 and the top supporting frame 22. Thus, the top supporting frame 22 may be suspenedly supported above the base supporting frame 21 by the connecting member 23. The base supporting frame 21 may be divided into an upper compartment 24 and a lower compartment 25.

As shown in FIG. 2 to FIG. 4 and FIG. 11 of the drawings, the base supporting frame 21 may comprise an upper supporting platform 211, a first sidewall 212 and a second sidewall 213 downwardly extended from two sides of the upper supporting platform 211, wherein the lower compartment 25 may be formed as the space surrounded by the upper supporting platform 211 and the two sidewalls 212, 213. The lower compartment 25 may be freely accessible from a front side or a rear side of the base supporting frame 21. Thus, the base supporting frame 21 may be embodied as having a substantially hollow structure.

On the other hand, the upper compartment 24 may be formed as a space above the upper supporting platform 211 of the base supporting frame 21. Many of the mechanical and electrical components may be supported on the upper supporting platform 211 in the upper compartment 24.

The gate opening apparatus may further comprise a power adapter 80 securely supported in the lower compartment 25 and electrically connected to an external power source, such as an external AC power source. The power adapter 80 may be electrically connected to the gate actuating arrangement 70 and the motor device 30. The power adapter 80 may be configured to convert an external AC voltage into a predetermined DC voltage and supply DC power to the gate actuating arrangement 70 and the motor device 30. A switch 81 may be provided on the power adapter 80 for allowing a user to control an on/off status of the present invention.

The motor device 30 may be supported by the base supporting frame 21 of the main chassis 20 at a position above the clutching device 71 of the gate actuating arrangement 70. The motor device 30 may be arranged to provide a driving force to drive the driving rotor 40 (through the clutching device 71) to rotate. This in turn may drive the door gate 100 to slide.

The clutching device 71 may be securely supported on the upper supporting platform 211 of the base supporting frame 21 in the upper compartment 24. The motor device 30 may be supported on top of and operatively connected to the clutching device 71. As shown in FIG. 6 to FIG. 10 of the drawings, the clutching device 71 may comprise a main casing 74, a transmission shaft assembly 75 operatively supported in the main casing 74, and a driving shaft mechanism 76 connected to the transmission shaft assembly 75.

The main casing 74 may be supported underneath the motor device 30 and on the upper supporting platform 211 of the base supporting frame 21. The transmission shaft assembly 75 may comprise a transmission shaft 751 connected to the driving motor 30 and may be driven to rotate by the driving motor 30. On the other hand, the transmission shaft 751 may be connected to the driving shaft mechanism 76 for driving the driving rotor 40 to rotate through the driving shaft mechanism 76. In other words, the transmission shaft 751 may be arranged to convert the mechanical torque delivered from the motor device 30 to the driving rotor 40 through the driving shaft mechanism 76. The transmission shaft 751 may be rotatably supported in the main casing 74 and is substantially aligned with motor device 30, such that a shaft of the motor device 30 may be adapted to drive the transmission shaft 751 to rotate.

Figure 6:
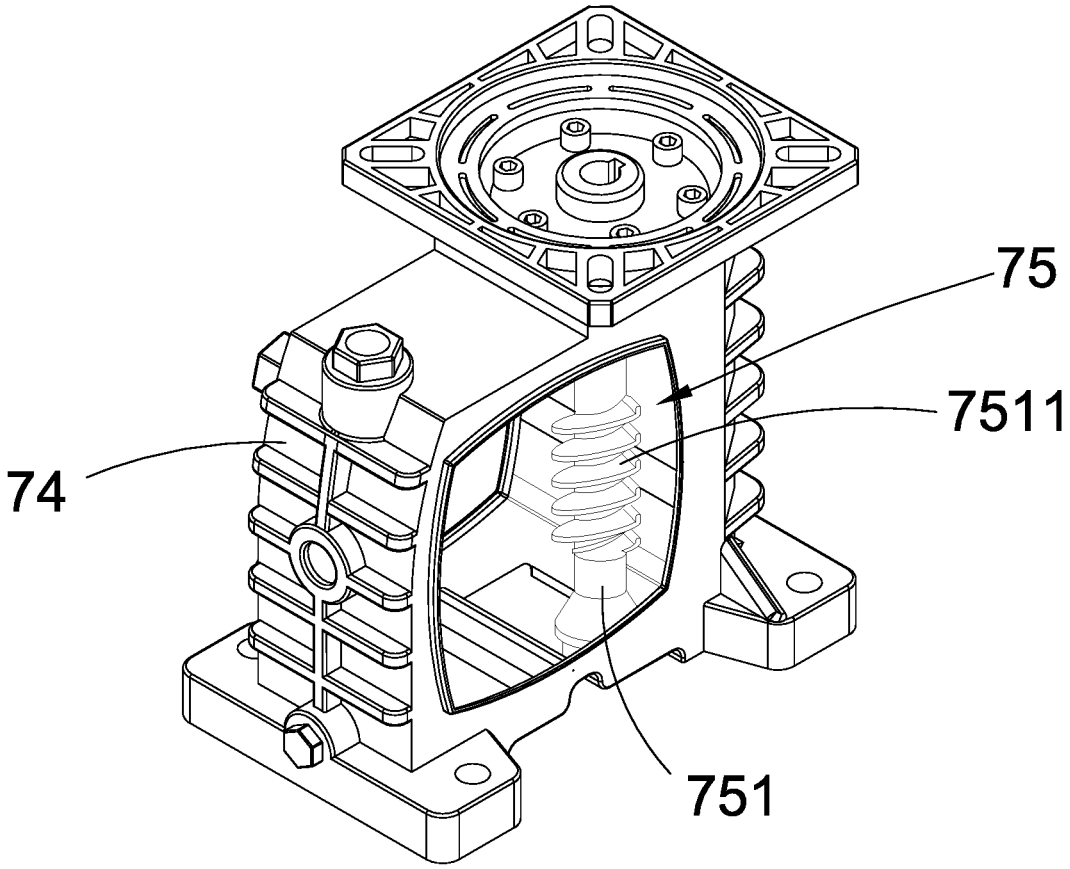
FIG. 6 is a perspective schematic diagram of a transmission shaft assembly according to the preferred embodiment of the present invention.
Figure 7:
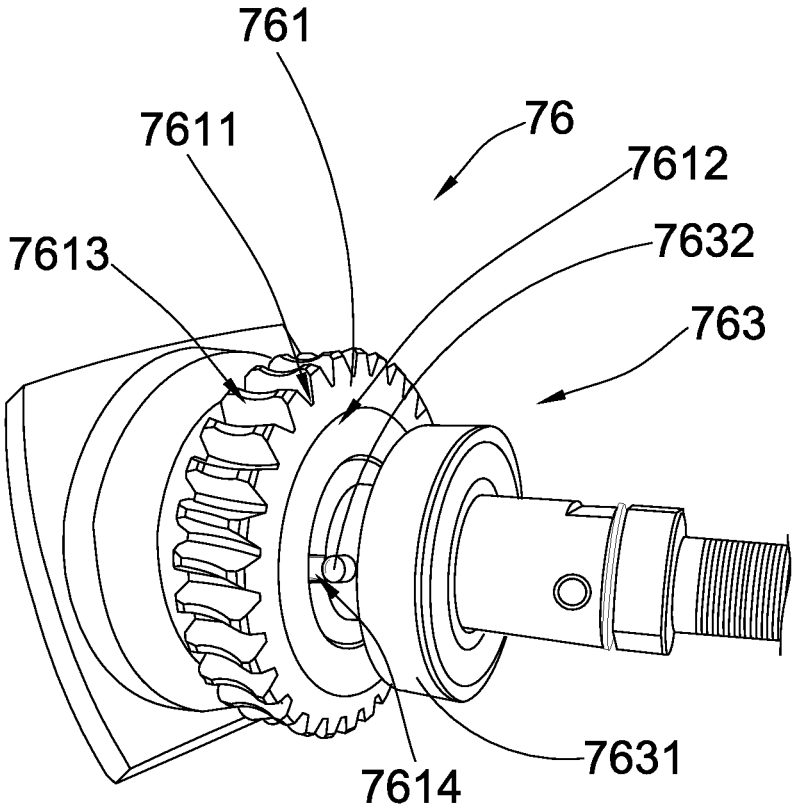
FIG. 7 is a perspective schematic diagram of a driving shaft mechanism according to the preferred embodiment of the present invention.
Figure 8:
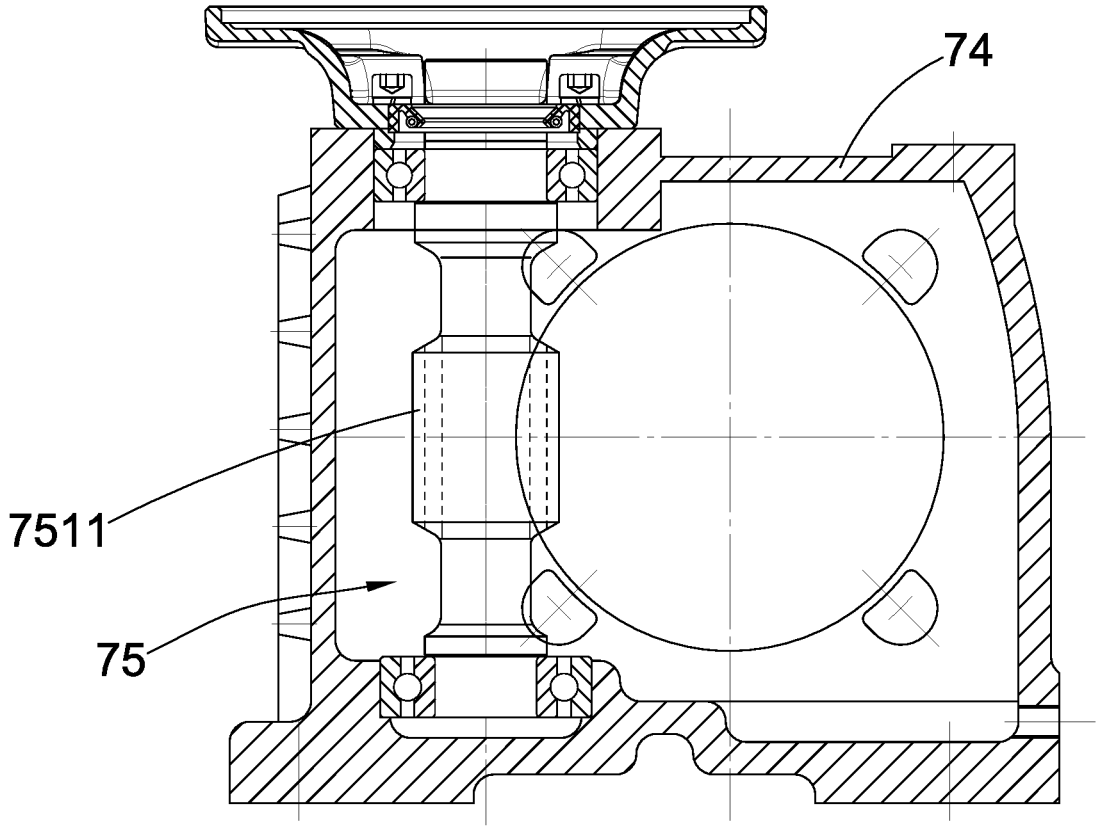
FIG. 8 is a sectional front view of the clutching device according to the preferred embodiment of the present invention.

As shown in FIG. 6 to FIG. 8 of the drawings, the transmission shaft 751 may have a worm gear 7511 formed on a mid-portion thereof for transmitting the mechanical torque to the driving shaft mechanism 76. On the other hand, the driving shaft mechanism 76 may comprise a wheel gear 761, a driving shaft assembly 762 and a control shaft assembly 763. The wheel gear 761 may be rotatably engaged with the worm gear 7511 of the transmission shaft 751 so that a rotational movement of the transmission shaft 751 may be converted into rotational movement of the worm gear 7511 and the wheel gear 761. Thus, the worm gear 7511 and the wheel gear 761 may form a worm and wheel gear assembly. Mechanical drive may be transmitted through approximately 90° through this worm and wheel gear assembly. The driving shaft assembly 762 and the control shaft assembly 763 may therefore rotate about a transverse axis of the main casing 74.

Figure 2:
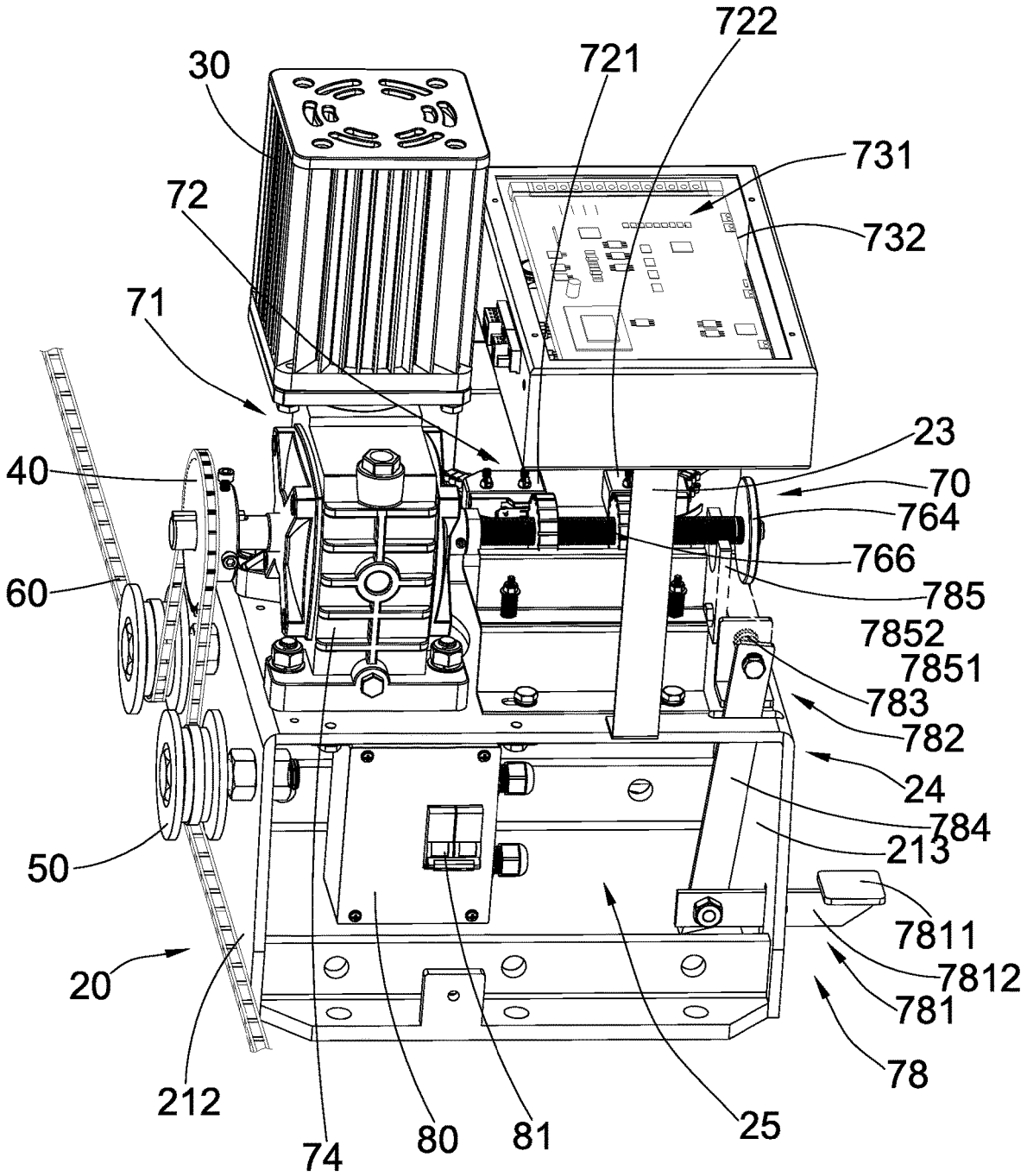
FIG. 2 is a front perspective view of the gate opening apparatus according to the preferred embodiment of the present invention.
Figure 3:
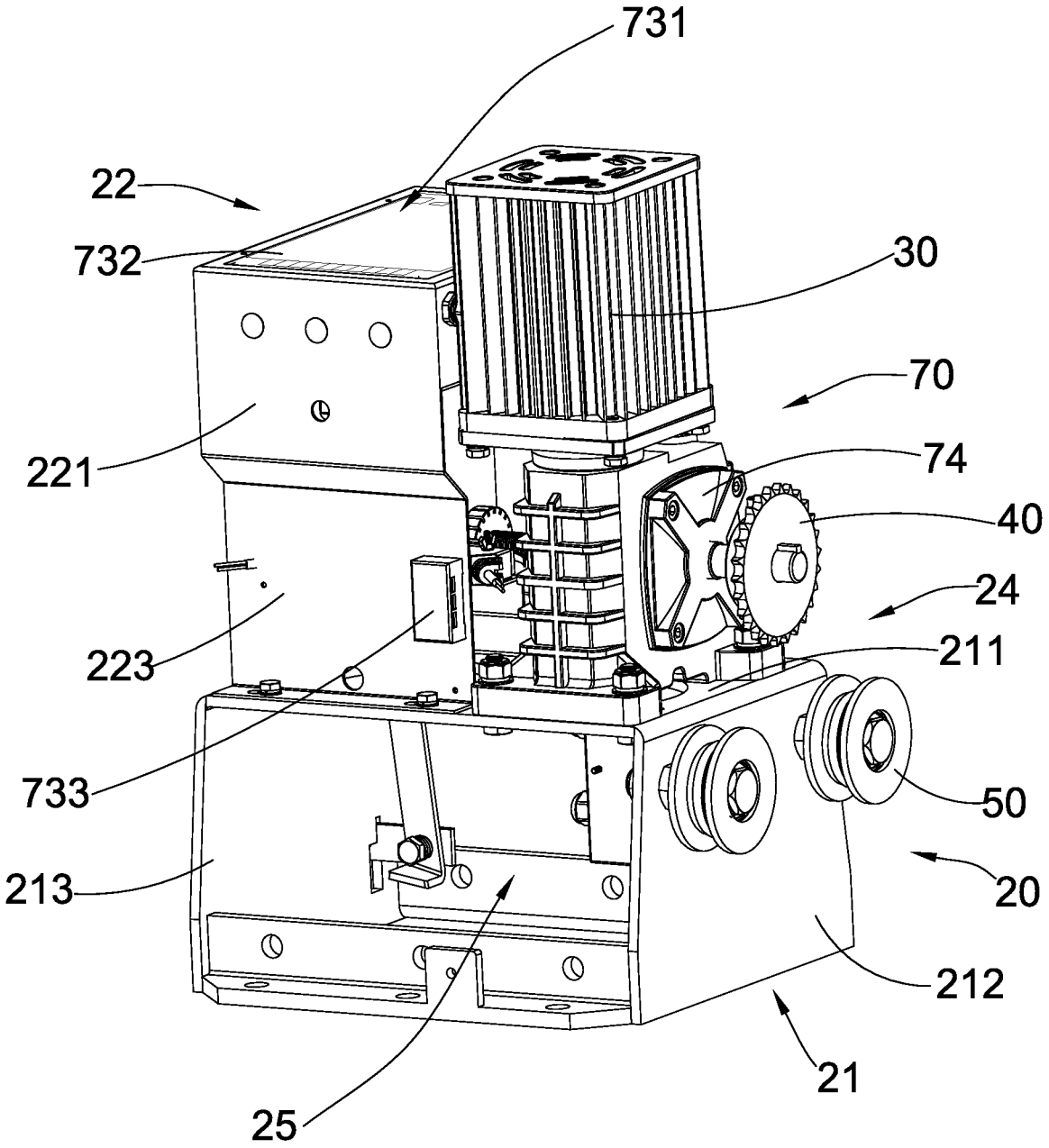
FIG. 3 is a rear perspective view of the gate opening apparatus according to the preferred embodiment of the present invention.
Figure 9:
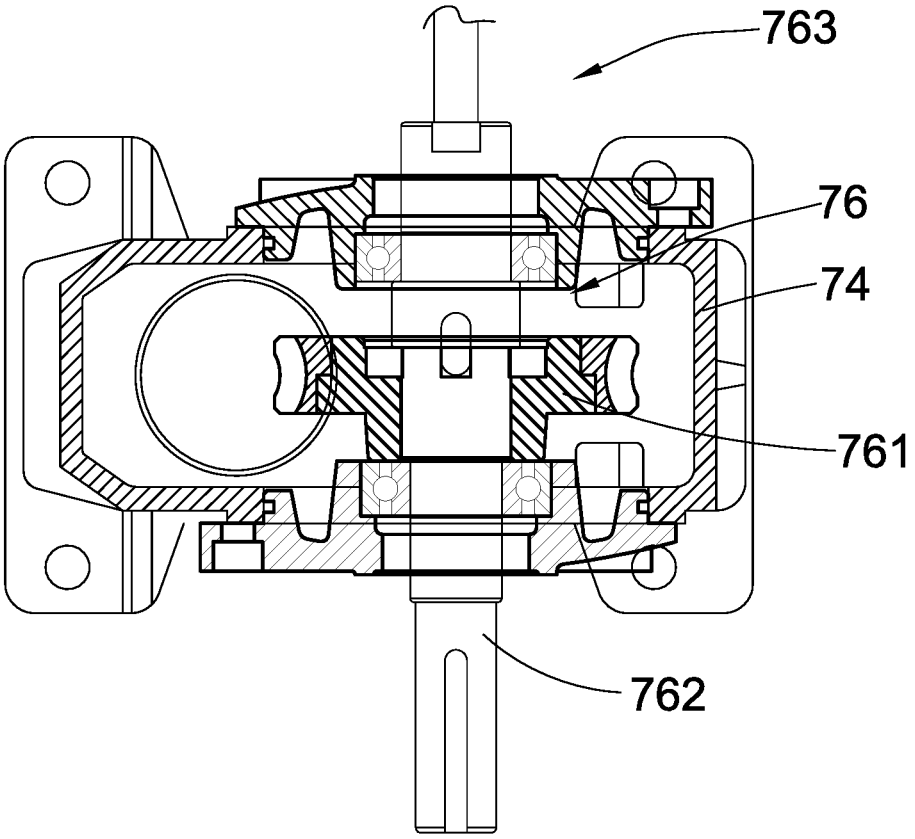
FIG. 9 is a sectional top view of the clutching device according to the preferred embodiment of the present invention.

The driving shaft assembly 762 and the control shaft assembly 763 may extend from the wheel gear 761 at opposite directions. As shown in FIG. 2 and FIG. 9 of the drawings, the control shaft assembly 763 may extend above the upper supporting platform 211 and connect to the limit switch 72. When the wheel gear 761 is driven to rotate, the driving shaft assembly 762 and the control shaft assembly 763 may also be driven to rotate.

The wheel gear 761 may have an outer annular portion 7611, an inner coupling portion 7612, and a plurality of wheel gear teeth 7613 formed on the outer annular portion 7611 to engage with the worm gear 751. The wheel gear 761 may further have a coupling slot 7614 formed on the inner coupling portion 7612.

The driving shaft assembly 762 may extend from the wheel gear 761 to connect to the driving rotor 40 for driving the driving rotor 40 to rotate. When the driving rotor 40 is driven to rotate, the transmission chain 60 may be mechanically actuated to move the door gate 100 for opening or closing thereof. The limit switch 72 may be provided on the control shaft assembly 763 for setting a limit through which the driving shaft assembly 762 may be rotated. This in turns may set a time and distance through which the door gate 100 is opened or closed. At the same time, the control shaft assembly 763 may also be driven to rotate.

The control shaft assembly 763 may comprise a coupler housing 7631 and a coupling member 7632 operatively supported in the coupler housing 7631. The coupler housing 7631 may be sized and shaped to selectively accommodate in the wheel gear 761 while the coupling member 7632 may extend out of the coupler housing 7631 to interlock with the coupling slot 7614 of the inner coupling portion 7612 of the wheel gear 761. The control shaft assembly 763 may further comprise a control shaft 7633 extended from the coupler housing 7631 on the upper supporting platform 211.

When the coupler housing 7631 is received in the wheel gear 761 and the coupling member 7632 interlocking with the coupling slot 7614 of the wheel gear 761, any rotational movement on the wheel gear 761 (for example, rotational movement driven by the worm gear 7511) may drive the coupler housing 7631 and the control shaft 7633 to rotate as well. On the other hand, when the coupling member 7632 is disengaged from the wheel gear 761, a rotational movement of the wheel gear 761 will no longer drive the coupler housing 7631 to rotate.

Figure 10:
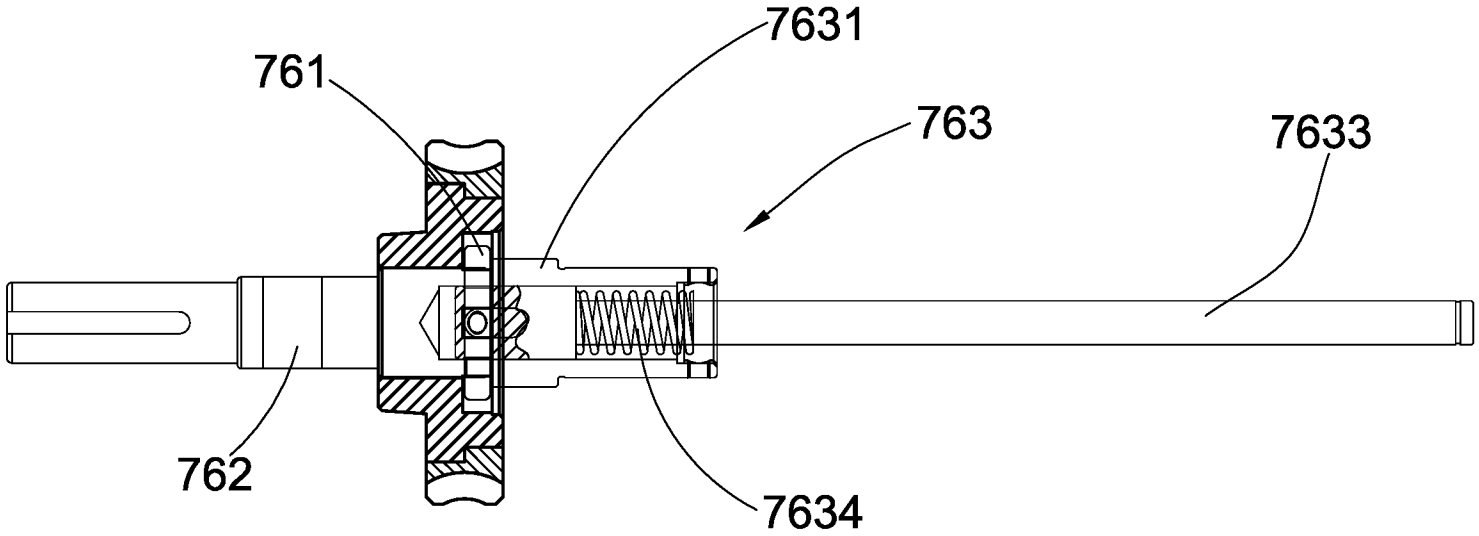
FIG. 10 is a sectional schematic diagram of the driving shaft mechanism according to the preferred embodiment of the present invention.
Figure 11:
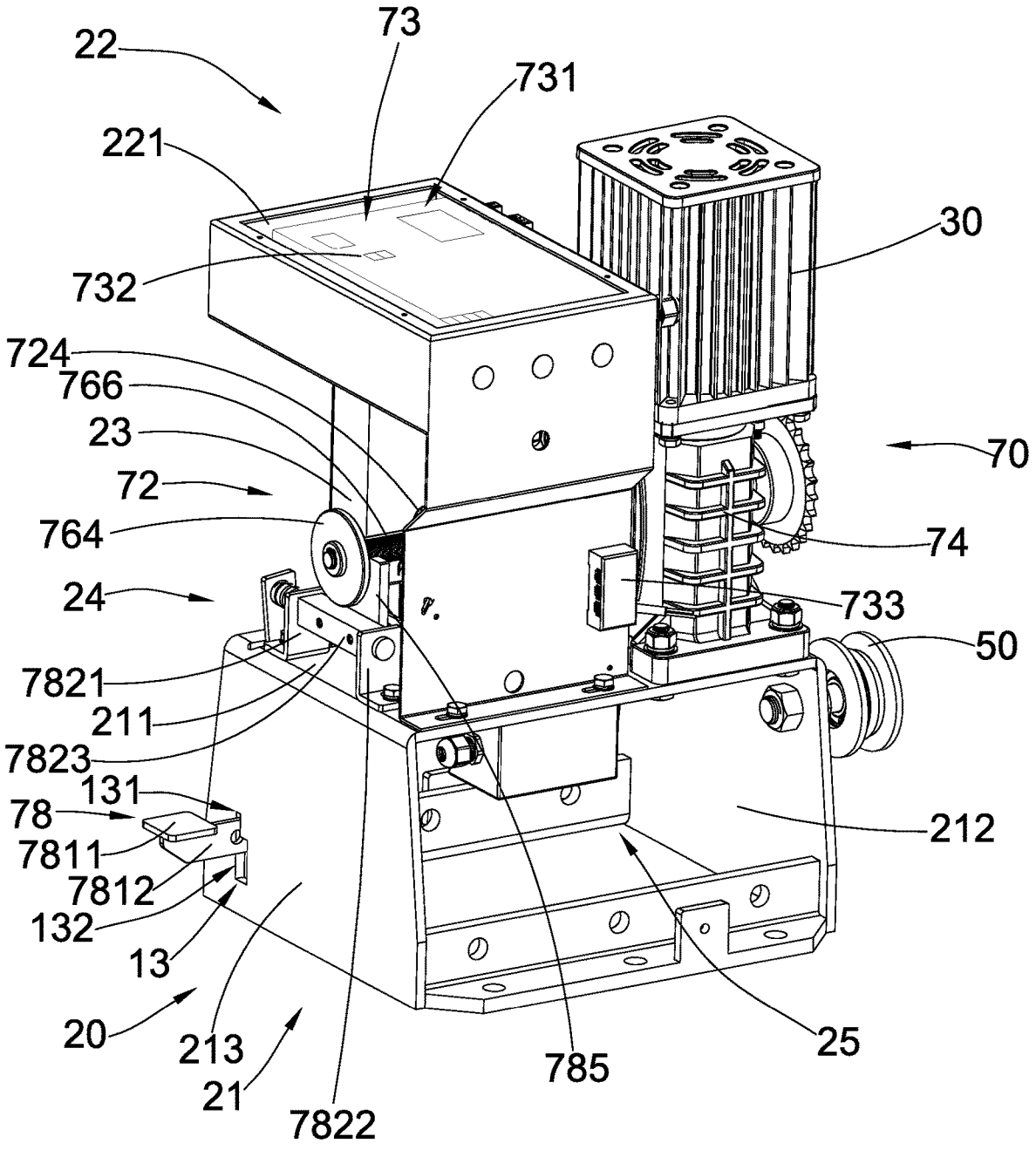
FIG. 11 another perspective view of the main chassis of the gate opening apparatus according to the preferred embodiment of the present invention.

As shown in FIG. 10 of the drawings, the driving shaft assembly 763 may further comprise a spring member 7634 mounted in the coupler housing 7631 for normally exerting a biasing force against a corresponding end of the control shaft 7633.

The driving shaft mechanism 76 may further comprise a tubular control member 766 mounted on the control shaft 7633, wherein the tubular control member 766 may be circumferentially threaded to engage with the limit switch 72. The control shaft 7633 may normally be embedded in the tubular control member 766 in such a manner that when the control shaft 7633 is driven to rotate, the tubular control member 766 may also be driven to rotate.

The limit switch 72 may comprise a first stopping switch 721 and a second stopping switch 722 spacedly mounted on the upper supporting platform 211 of the base supporting frame 21, a first biasing member 723 and a second biasing member 724 spacedly mounted on the tubular control member 766 which may be supported on the control shaft assembly 763. The first stopping switch 721 and the second stopping switch 722 may be electrically connected to the control module 73 in such a manner that when either one of the first stopping switch 721 or the second stopping switch 722 are actuated, the control module 73 may control the operation of the motor device 30 in a predetermined manner (described below).

Each of the first stopping switch 721 and the second stopping switch 722 may have a position sensor 725 for sensing the position of the first biasing member 723 and the second biasing member 724 respectively. In this preferred embodiment, the position sensors 725 are mechanical sensors which may be formed by elastic metallic plates. The first biasing member 723 and the second biasing member 724 may be moved to bias against the position sensor 725 of the first stopping switch 721 and the second stopping switch 722 respectively for physically actuating the them.

Thus, the first biasing member 723 and the second biasing member 724 may be mounted on the tubular control member 766 in such a manner that when the tubular control member 766 rotates, the first biasing member 723 and the second biasing member 724 may be driven to travel along a longitudinal direction of the tubular control member 766. When the first biasing member 723 and the second biasing member 724 travel along a longitudinal direction of the tubular control member 766, the first biasing member 723 may be traveled to bias against the first stopping switch 721 when the tubular control member 766 rotates in one predetermined direction. Conversely, the second biasing member 724 may be traveled to bias against the second stopping switch 722 when the tubular control member 766 rotates in an opposed direction.

In order to accomplish the above-mentioned actuating movements, the tubular control member 766 may have a threaded circumferential surface for engaging with the first biasing member 723 and the second biasing member 724, which may be configured to have an annular or ring-shaped structure. The first biasing member 723 may have a first through hole for allowing the tubular control member 766 to pass therethrough, and a plurality of first engaging teeth 7232 spacedly formed along on a circumferential surface of the first biasing member 723. Each of the first engaging teeth 7232 may be formed between two first indentions 7233 formed on the circumferential surface of the first biasing member 723. The first through hole may be bored for threadedly engagingly with the tubular control member 766.

Similarly, the second biasing member 724 may have a second through hole and a plurality of second engaging teeth 7242 spacedly formed along a circumferential surface of the second biasing member 724. Each of the second engaging teeth 7242 may be formed between two second indentions 7243 formed on the circumferential surface of the second biasing member 724. The second through hole may be bored for threadedly engaging with the tubular control member 766.

In addition, the gate actuating arrangement 70 may further comprise an engagement platform 77 provided on the upper supporting platform 211 of the base supporting frame 21 for supporting and operatively engaging with the first biasing member 723 and the second biasing member 724. Specifically, the engagement platform 77 may be upwardly extended from the upper supporting platform 211 and have an engagement edge portion 771 extended to engage with one of the first indentions 7233 and the second indentions 7243 so that the first biasing member 723 and the second biasing member 724 may partially rest on the engagement edge portion 771 of the engagement platform 77. Thus, when the first biasing member 723 and the second biasing member 724 are engaged with the engagement edge portion 771 of the engagement platform 77, a rotational movement of the tubular control member 766 may drive the first biasing member 723 and the second biasing member 724 to move longitudinally along the tubular control member 766.

The first biasing member 723 and the second biasing member 724 may then move longitudinally to bias against the first stopping switch 721 and the second stopping switch 722 as controlled by the rotation of the tubular control member 766 of the driving shaft mechanism 76. Note that the engagement platform 77 may have a predetermined elasticity or deformability so that the engagement between the engagement edge portion 771 and the first biasing member 723 and the second biasing member 724 may be selectively removed. Thus, the engagement edge portion 771 may be slightly deformed by manual force so as to disengage the engagement edge portion 771 from the first biasing member 723 and the second biasing member 724. After disengagement, the first biasing member 723 and the second biasing member 724 may be rotated about the tubular control member 766 and travel in a longitudinal direction thereof. A user of the present invention may thus determine the positions of the first biasing member 723 and the second biasing member 724 by manually rotating them along the tubular control member 766. When the positions of the first biasing member 723 and the second biasing member 724 are set, the user may release the manual force exerted to the engagement edge portion 771 and allow the engagement edge portion 771 to restore to its original shape. The engagement edge portion 771 may then be arranged to engage with first engagement teeth 7232 and the second engagement teeth 7242 again. The above steps may allow a user of the present invention to manually set the extent to which the door gate 100 may be slid, because the sliding distance of the door gate 100 may be determined by a distance between the first biasing member 723 and the second biasing member 724.

The gate actuating arrangement 70 may further comprise a manual actuation arrangement 78 mounted on the main chassis 20 and operatively connected to the driving shaft mechanism 76 for selectively switching the driving shaft mechanism 76 from power operated (power mode) to manually operated (manual mode), or vice versa. The manual actuation arrangement 78 may allow a user of the preset invention to manually slide the door gate 100 when the gate opening apparatus is not working or otherwise necessary, such as when electricity supply is temporarily cut off.

The driving shaft mechanism 76 may further comprise an end plate 764 provided on a free end of the control shaft assembly 763. The end plate 764 may operate with the manual actuation arrangement 78 for switching the gate opening apparatus from power mode to the manual mode.

As shown in FIG. 2 of the drawings, the manual actuation arrangement 78 may comprise an actuation pedal 781, a securing frame 782 provided on the upper supporting platform 211 of the base supporting frame 21, a resilient element 783 mounted on the securing frame 782, a manual actuation link 784 operatively and pivotally connecting between the actuation pedal 781 and the securing frame 782, and a pushing member 785 pivotally connected to the securing frame 782.

The actuation pedal 781 may be supported on the main chassis 20 and extend out of the external housing 10 for allowing a user to step thereon. In this preferred embodiment of the present invention, the actuation pedal 781 may be provided on a side surface of the external housing 10 and the main chassis 20 at a position opposite to the driving rotor 40. Each of the external housing 10 and the main chassis 20 may further has a through manual actuation slot 13 for allowing the actuation pedal 781 to pass therethrough.

The securing frame 782 may be provided on the upper supporting platform 211 at a position adjacent to the engagement platform 77. When viewed from the side (see FIG. 5 of the drawings), the securing frame 782 may be provided below the tubular control member 766. The securing frame 782 may comprise a first frame member 7821, a second frame member 7822 spaced apart from the first frame member 7821, and an elongated pivotal member 7823 pivotally extended between the first frame member 7821 and the second frame member 7822. Thus, the elongated pivotal member 7823 may be pivotally moved about the first frame member 7821 and the second frame member 7822. The resilient element 783 may be mounted on the elongated pivotal member 7823 for normally biasing against the manual actuation link 784 and the pushing member 785 in a manner described below.

The elongated pivotal member 7823 may have a main pivotal portion 7824 provided between the first frame member 7821 and the second frame member 7822, and an extension shaft portion 7825 extended from the main pivotal portion 7824 to connect to the manual actuation link 784.

The manual actuation link 784 may be configured as an elongated member and may have one end pivotally connected to the actuation pedal 781, and another end pivotally connected to the extension shaft portion 7825 of the elongated pivotal member 7823. Moreover, the manual actuation link 784 may also be connected to the resilient element 783 which may be mounted on the extension shaft portion 7825 of the elongated pivotal member 7823.

The resilient element 783 may be configured as a coil spring which may be mounted on the extension shaft portion 7825. One end of the resilient element 783 may be arranged to bias against the manual actuation link 784 while the other end of the resilient element 783 may be arranged to bias against the first frame member 7821 of the securing frame 782. The resilient element 783 may be arranged to normally exert a biasing force toward the elongated pivotal member 7823 so as to normally retain the gate opening apparatus in the power mode.

Figure 4:
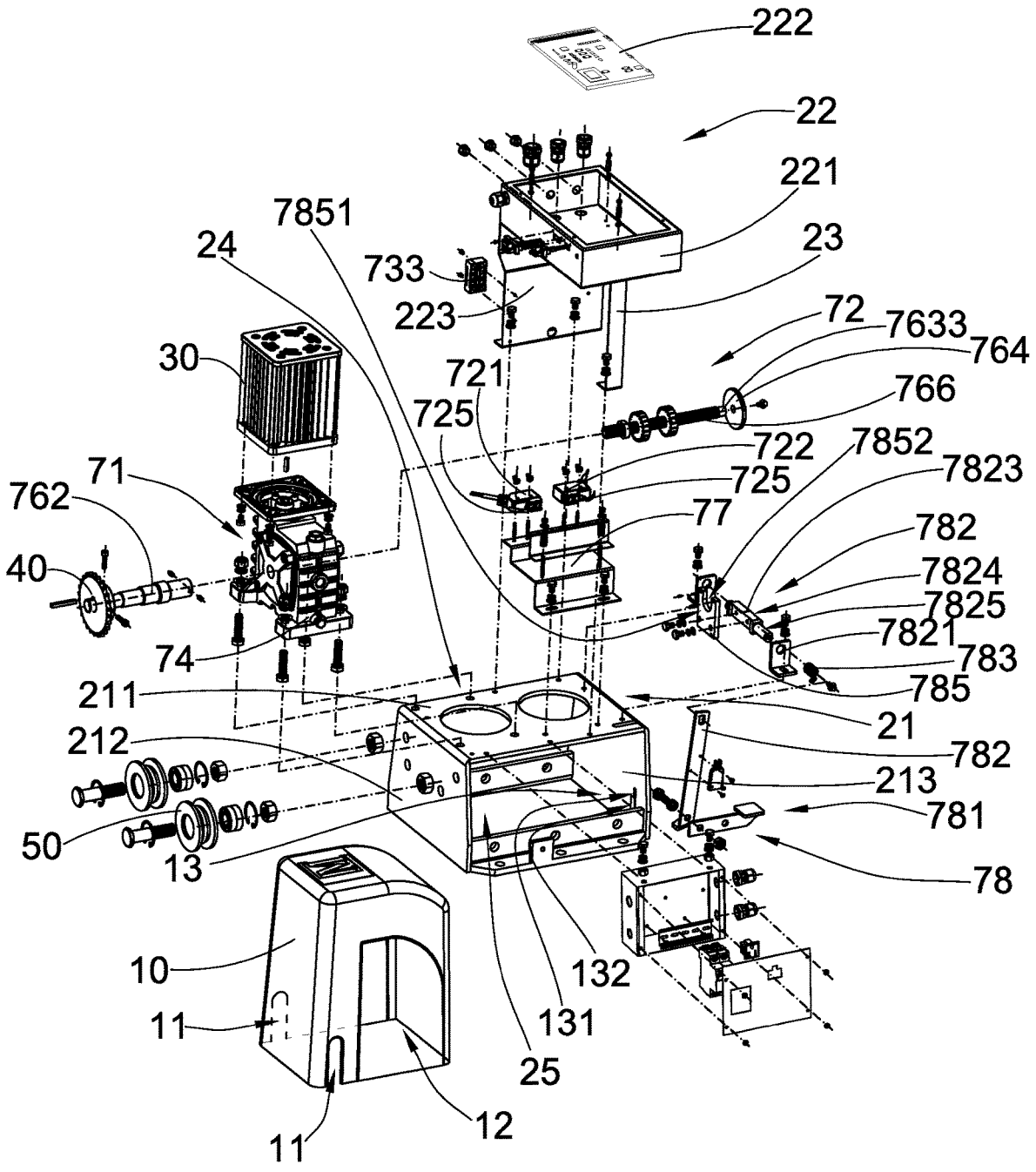
FIG. 4 is an exploded perspective view of the gate opening apparatus according to the preferred embodiment of the present invention.
Figure 5:
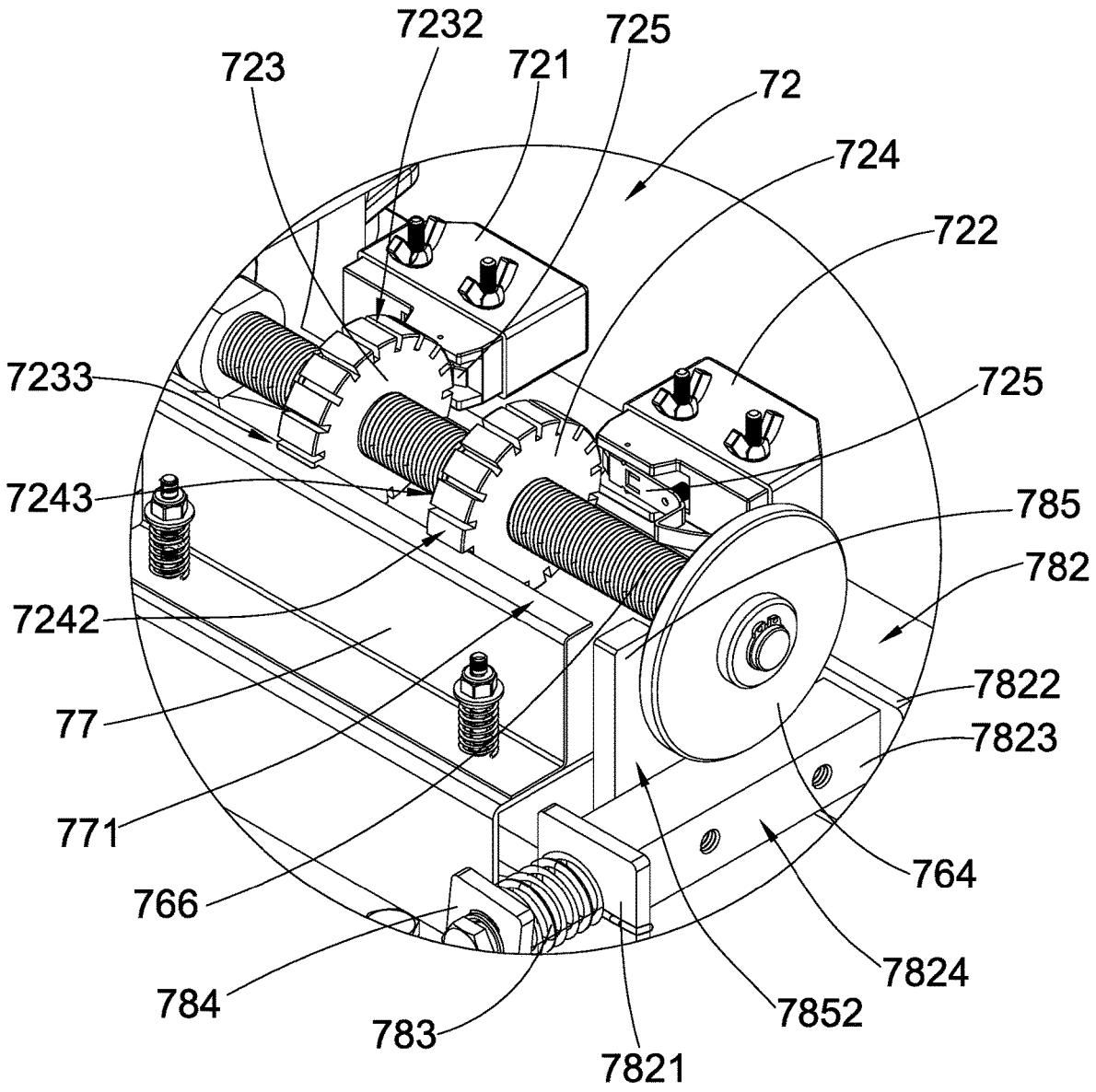
FIG. 5 is another schematic diagram of the gate opening apparatus according to the preferred embodiment of the present invention, illustrating a tubular control member and a limit switch.

The pushing member 785 may be connected to the main pivotal portion 7824 of the elongated pivotal member 7823 so that a pivotal movement of the elongated pivotal member 7823 may pivotally drive the pushing member 785 to move as well. Referring to FIG. 4 of the drawings, the pushing member 785 may have a lower portion 7851 connected to the main pivotal portion 7824, and an accommodating slot 7852 formed above the lower portion for allowing the control shaft 7633 to pass therethrough. The end plate 764 may be provided at an outer side of the pushing member 785. Thus, the control shaft 7633 may extend from the coupler housing 7631 and penetrate through the accommodating slot 7852 to securely connect to the end plate 764. The pushing member 785 may be positioned adjacent to the end plate 764.

When the pushing member 785 pushes the end plate 764, a corresponding end portion of the control shaft 7633 may be pushed outwardly with respect to the main chassis 20. This may cause the coupler housing 7631, which may be connected to the control shaft 7633, to disengage from the wheel gear 761 and therefore a further rotational movement of either the control shaft 7633 or the wheel gear 761 may not affect the other component. When this happens, a user may be able to manually slide the door gate 100 for opening or closing it. Since the wheel gear 761 and the control shaft assembly 763 has been engaged, little mechanical resistance may exist on the part of the driving shaft assembly 762 when the user tries to slide the door gate 100.

In order to retain the gate opening apparatus in the manual mode, at least one manual actuation slot 13 (e.g. the manual actuation slot 13 formed on the main chassis 20) may have an idle portion 131 and a retention portion 132 formed adjacent to the idle portion 131 for retaining the actuation pedal 781 in a depressed position. Specifically, and as shown in FIG. 2 to FIG. 11 of the drawings, the actuation pedal 781 may comprise a pedal member 7811 extended out of the external housing 10 for allowing a user to step thereon, and a pedal connecting member 7812 connecting the pedal member 7811 to a lower portion of the manual actuation link 784. The pedal connecting member 7812 may be pivotally connected to the manual actuation link 784 so that when the pedal member 7811 is depressed, the pedal connecting member 7812 may also be driven to move downwardly in the manual actuation slot 13 to pivotally actuate the manual actuation link 784.

The pedal connecting member 7812 may movably penetrate the idle portion 131 of the manual actuation slot 13. The idle portion 131 may be configured as having an elongated contour for fittedly receiving the pedal connecting member 7812. The retention portion 132 may be formed at a position adjacent to the idle portion 131. A height of the retention portion 132 may be less than that of the idle portion 131. When the actuation pedal 781 is depressed in the idle portion 131 of the manual actuation slot 13, the user may be able to slightly push the pedal member 7811 and the pedal connecting member 7812 rearwardly with respect to the main chassis 20 so as to allow them to accommodate in the retention portion 132. After that, the user may release his manual actuation force and the pedal connecting member 7812 may be retained to bias against a top edge of the retention portion 132 of the manual actuation slot 13. This in turns keeps the pushing member 785 continue pushing the end plate 764 for retaining the gate opening apparatus in the manual mode.

In order to allow the gate opening apparatus to return to the power mode, the user may slightly depress the pedal connecting member 7812 (preferably through depressing the pedal member 7811) frontwardly (with respect to the main chassis) push the pedal connecting member 7812 back to the idle portion 131. Due to the resilient nature of the resilient element 783, when the user releases his manual force, the pedal connecting member 7812 may return to its original position and the pushing member 785 may cease pulling the control shaft 7633. The control shaft 7633 may then return to its original position by the biasing force exerted by the spring member 7634. The coupler housing 7631 may return to its original position and engage with the wheel gear 761 again.

The control module 73 may comprise a control circuitry 731 and a control Printed Circuit Board (PCB) 732 supported by the top supporting frame 22 of the main chassis 20. The top supporting frame 22 may comprise a top receiving compartment 221 suspendedly supported above the base supporting frame 21, a top cover 222 detachably covering the top receiving compartment 221, and a rear panel 223 extended between the top receiving compartment 221 and the upper supporting platform 211 of the base supporting frame 21 at a position opposite to the connecting member 23.

The control circuitry 731 may be implemented on the control PCB 732 which may be securely received in the top receiving compartment 221 of the top supporting frame. The control circuitry 731 may be arranged to control the operation of the gate opening apparatus.

The control module 73 may further comprise a wireless control sensor 733 provided on the main chassis 20 preferably on the rear panel 223 and electrically connected to the control circuitry 731 for receiving remote control signal from a remote control. The wireless control sensor 733 may facilitate wireless control on the operation of the gate opening apparatus.

The present invention, while illustrated and described in terms of a preferred embodiment and several alternatives, is not limited to the particular description contained in this specification. Additional alternative or equivalent components could also be used to practice the present invention.

What is claimed is:

1. A gate opening apparatus for a door gate, comprising:

an external housing;

a main chassis received in said external housing, wherein said main chassis comprises a base supporting frame comprising an upper supporting platform, a first sidewall and a second sidewall downwardly extended from two sides of said upper supporting platform to define a lower compartment as a space surrounded by said upper supporting platform and said first sidewall and said second sidewall, said base supporting frame further defining an upper compartment as a space formed above said upper supporting platform of said base supporting frame;

a motor device provided in said main chassis;

a driving rotor rotatably mounted on said main chassis;

a plurality of guiding rollers rotatably mounted on said main chassis;

a transmission chain connecting said driving rotor, said guiding rollers and said door gate such that rotation of said driving rotor is capable of driving said door gate to slide along a predetermined direction through said guiding rollers and said transmission chain; and a gate actuating arrangement, which comprises:

a clutching device securely supported on said main chassis and connected to said motor device;

a limit switch assembly coupled to said clutching device, said limit switch assembly being arranged to set a limit upon which said driving rotor is rotated; and a control module mounted on said main chassis and electrically connected to said motor device and said clutching device for controlling an operation thereof, said gate opening apparatus being arranged to operate between a power mode and a manual mode, wherein in said power mode, said clutching device is engaged with said driving rotor for driving a movement thereof by said motor device so as to selectively open and close said door gate, wherein in said manual mode, said clutching device is disengaged from said driving rotor so that said driving rotor is adapted for being rotated manually.

2. The gate opening apparatus, as recited in claim 1, wherein said clutching device comprises a main casing, a transmission shaft assembly operatively supported in said main casing, and a driving shaft mechanism connected to said transmission shaft assembly, said main casing being supported underneath said motor device and on said upper supporting platform of said base supporting frame, said transmission shaft assembly comprising a transmission shaft connected to said driving motor for being driven to rotate by said driving motor, said transmission shaft connecting to said driving shaft mechanism for driving said driving rotor to rotate through said driving shaft mechanism when said transmission shaft is driven to rotate.

3. The gate opening apparatus, as recited in claim 2, wherein said transmission shaft has a worm gear formed on a mid-portion thereof for transmitting mechanical torque to said driving shaft mechanism, said driving shaft mechanism comprising a wheel gear, a driving shaft assembly connecting to said driving rotor, and a control shaft assembly connecting to said limit switch, said wheel gear rotatably engaging with said worm gear of said transmission shaft so that a rotational movement of said transmission shaft is converted to rotational movement of said worm gear and said wheel gear, said driving shaft assembly and said control shaft assembly extending from said wheel gear at two opposite directions respectively.

4. The gate opening apparatus, as recited in claim 3, wherein said wheel gear has an outer annular portion, an inner coupling portion, and a plurality of wheel gear teeth formed on said outer annular portion to engage with said worm gear, said wheel gear further having a coupling slot formed on said inner coupling portion for engaging with said control shaft assembly.

5. The gate opening apparatus, as recited in claim 4, wherein said control shaft assembly comprises a control shaft, a coupler housing, and a coupling member operatively supported in said coupler housing, said coupler housing being sized and shaped to selectively accommodate in said wheel gear while said coupling member extending out of said coupler housing to selectively interlock with said coupling slot of said inner coupling portion of said wheel gear, said control shaft extending from said coupler housing to operate with said limit switch.

6. The gate opening apparatus, as recited in claim 5, wherein said driving shaft assembly further comprises a spring member mounted in said coupler housing for normally exerting a biasing force against a corresponding end of said control shaft.

7. The gate opening apparatus, as recited in claim 6, wherein said driving shaft mechanism further comprises a tubular control member mounted on said control shaft, said tubular control member being circumferentially threaded to engage with said limit switch, said control shaft being normally embedded in said tubular control member in such a manner that when said control shaft is driven to rotate, said tubular control member is also driven to rotate.

8. The gate opening apparatus, as recited in claim 7, wherein said limit switch comprises a first stopping switch and a second stopping switch spacedly mounted on said upper supporting platform of said base supporting frame, a first biasing member and a second biasing member movably mounted on said tubular control member, said first stopping switch and said second stopping switch are electrically connected to said control module in such a manner that when one of said first biasing member and said second biasing member is driven to actuate said corresponding first stopping switch and said second stopping switch, said control module is arranged to control an operation of said motor device in a predetermined manner.

9. The gate opening apparatus, as recited in claim 8, wherein said tubular control member has a threaded circumferential surface for engaging with said first biasing member and said second biasing member, said first biasing member having a plurality of first engaging teeth spacedly formed along on a circumferential surface of said first biasing member, and a plurality of first indentions formed between each two first engaging teeth, said second biasing member having a plurality of second engaging teeth spacedly formed along a circumferential surface of said second biasing member, and a plurality of second indentions formed between each two said second engaging teeth, said first biasing member and said second biasing member being mounted on said tubular control member in such a manner that when said tubular control member rotates, said first biasing member and said second biasing member are driven to travel along a longitudinal direction of said tubular control member.

10. The gate opening apparatus, as recited in claim 9, wherein said main chassis further comprises an engagement platform provided on said upper supporting platform of said base supporting frame, said engagement platform having an engagement edge portion extended to engage with one of said first indentions and said second indentions so that said first biasing member and said second biasing member partially rest on said engagement edge portion of said engagement platform, said engagement platform having a predetermined elasticity for allowing a user to manually and selectively disengage said engagement edge portion and said first biasing member and said second biasing member.

11. The gate opening apparatus, as recited in claim 10, further comprising a manual actuation arrangement which comprises an actuation pedal, a securing frame provided on said upper supporting platform of said base supporting frame, a resilient element mounted on said securing frame, a manual actuation link operatively and pivotally connecting between said actuation pedal and said securing frame, and a pushing member pivotally connected to said securing frame.

12. The gate opening apparatus, as recited in claim 11, wherein said securing frame is provided on said upper supporting platform at a position adjacent to said engagement platform, said securing frame comprising a first frame member, a second frame member spaced apart from said first frame member, and an elongated pivotal member pivotally extended between said first frame member and said second frame member, said resilient element being mounted on said elongated pivotal member for normally biasing against said manual actuation link and said securing frame.

13. The gate opening apparatus, as recited in claim 12, wherein said elongated pivotal member has a main pivotal portion provided between said first frame member and said second frame member, and an extension shaft portion extended from said main pivotal portion to connect to said manual actuation link, said resilient element being mounted on said extension shaft portion.

14. The gate opening apparatus, as recited in claim 13, wherein said pushing member is connected to said main pivotal portion of said elongated pivotal member so that a pivotal movement of said elongated pivotal member is arranged to pivotally drive said pushing member to move, said pushing member having a lower portion connected to said main pivotal portion, and an accommodating slot formed above said lower portion for allowing said control shaft to pass therethrough.

15. The gate opening apparatus, as recited in claim 14, wherein said driving shaft mechanism further comprises an end plate provided on a free end of said control shaft, said end plate operating with said manual actuation arrangement for switching said gate opening apparatus from power mode to said manual mode, said end plate being provided at an outer side of said pushing member, so that said control shaft is arranged to extend from said coupler housing and penetrate through said accommodating slot to securely connect to said end plate.

16. The gate opening apparatus, as recited in claim 15, wherein said main chassis further comprises a top supporting frame suspendedly supported above said base supporting frame, said control module being supported on said top supporting frame.

17. The gate opening apparatus, as recited in claim 10, wherein said main chassis further comprises a top supporting frame suspendedly supported above said base supporting frame, said control module being supported on said top supporting frame.

18. The gate opening apparatus, as recited in claim 1, further comprising a manual actuation arrangement which comprises an actuation pedal, a securing frame provided on said upper supporting platform of said base supporting frame, a resilient element mounted on said securing frame, a manual actuation link operatively and pivotally connecting between said actuation pedal and said securing frame, and a pushing member pivotally connected to said securing frame.

19. The gate opening apparatus, as recited in claim 18, wherein said securing frame is provided on said upper supporting platform, said securing frame comprising a first frame member, a second frame member spaced apart from said first frame member, and an elongated pivotal member pivotally extended between said first frame member and said second frame member, said resilient element being mounted on said elongated pivotal member for normally biasing against said manual actuation link and said securing frame.

20. The gate opening apparatus, as recited in claim 19, wherein said elongated pivotal member has a main pivotal portion provided between said first frame member and said second frame member, and an extension shaft portion extended from said main pivotal portion to connect to said manual actuation link, said resilient element being mounted on said extension shaft portion.

21. The gate opening apparatus, as recited in claim 20, wherein said pushing member is connected to said main pivotal portion of said elongated pivotal member so that a pivotal movement of said elongated pivotal member is arranged to pivotally drive said pushing member to move, said pushing member having a lower portion connected to said main pivotal portion, and an accommodating slot formed above said lower portion.

22. The gate opening apparatus, as recited in claim 21, wherein said driving shaft mechanism further comprises an end plate provided on said control shaft assembly, said end plate operating with said manual actuation arrangement for switching said gate opening apparatus from power mode to said manual mode, said end plate being provided at an outer side of said pushing member.

* * * * *